US011214987B2

(12) United States Patent
Telang et al.

(10) Patent No.: US 11,214,987 B2
(45) **Date of Patent: *Jan. 4, 2022**

(54) COMPACT BIKE LOCK

(71) Applicant: Schlage Lock Company LLC, Carmel, IN (US)

(72) Inventors: Ravi Telang, Bidar (IN); Kavya Madhusudhan, Seattle, WA (US)

(73) Assignee: Schlage Lock Company LLC, Carmel, IN (US)

( * ) Notice: Subject to any disclaimer, the term of this patent is extended or adjusted under 35 U.S.C. 154(b) by 52 days.

This patent is subject to a terminal disclaimer.

(21) Appl. No.: 16/807,937

(22) Filed: Mar. 3, 2020

(65) Prior Publication Data

US 2020/0308877 A1 Oct. 1, 2020

Related U.S. Application Data

(63) Continuation of application No. 16/100,702, filed on Aug. 10, 2018, now Pat. No. 10,577,833.

(51) Int. Cl.

| | |
|---|---|
| ***E05B 67/06*** | (2006.01) |
| ***E05B 67/24*** | (2006.01) |
| ***E05B 71/00*** | (2006.01) |

(52) U.S. Cl.
CPC ..... *E05B 67/063* (2013.01)

(58) Field of Classification Search
CPC .. E05B 67/063; E05B 67/06; E05B 2067/066; E05B 67/18; E05B 67/22; E05B 7/24; E05B 71/00

(Continued)

(56) References Cited

U.S. PATENT DOCUMENTS

| | | | |
|---|---|---|---|
| 1,384,590 | A | 7/1921 | Bottone |
| 1,690,041 | A | 10/1928 | Sundquist |

(Continued)

FOREIGN PATENT DOCUMENTS

| | | | |
|---|---|---|---|
| DE | 810961 | C | 8/1951 |
| FR | 2739890 | A1 | 4/1997 |

OTHER PUBLICATIONS

International Search Report; International Searching Authority; International Application No. PCT/US2019/046180; dated Nov. 19, 2019; 2 pages.

(Continued)

*Primary Examiner* — Lloyd A Gall
(74) *Attorney, Agent, or Firm* — Taft Stettinius & Hollister LLP

(57) ABSTRACT

An exemplary shackle is configured for use with a crossbar having a pair of openings and a locking mechanism including a pair of deadbolts. The shackle includes a substantially flat plate portion having a length in a longitudinal direction, a width in a transverse direction, and a thickness along a lateral axis defining a proximal direction and a distal direction. The length is greater than the width, which is greater than the thickness. The shackle further includes a pair of longitudinally-offset legs extending distally from the plate portion. Each leg has a diameter, and includes a bumper and a notch positioned distally of the bumper. An offset distance is defined between the distal surface of the plate portion and the distal faces of the bumpers. The width of the plate portion is greater than each of the diameter and the offset distance.

20 Claims, 9 Drawing Sheets

(58) Field of Classification Search
USPC ... 70/24–26, 35–37, 38 R, 38 A, 38 B, 38 C, 70/39, 50–56, 233, 417
See application file for complete search history.

(56) References Cited

U.S. PATENT DOCUMENTS

| | | | |
|---|---|---|---|
| 2,904,985 | A | 9/1959 | Murphy |
| 2,983,133 | A | 5/1961 | Hruby |
| 3,345,837 | A | 10/1967 | Barnes |
| 3,453,846 | A | 7/1969 | Owen et al. |
| 3,631,896 | A | 1/1972 | Meigs |
| 3,908,415 | A | 9/1975 | Foote |
| 4,106,315 | A | 8/1978 | Dohanyos |
| 4,112,716 | A | 9/1978 | Wippich |
| 4,438,641 | A | 3/1984 | Levkov |
| 4,480,450 | A | 11/1984 | Brown |
| 4,524,591 | A | 6/1985 | Lanko |
| 4,802,351 | A | 2/1989 | Kojak |
| 4,918,949 | A | 4/1990 | Newbold |
| 5,010,746 | A | 4/1991 | Zane et al. |
| 5,123,267 | A | 6/1992 | Appelbaum |
| 5,333,476 | A | 8/1994 | Byrd, Jr. |
| 5,535,609 | A | 7/1996 | Kuo |
| 5,638,707 | A | 6/1997 | Gould |
| 5,901,588 | A | 5/1999 | Frost |
| 6,393,876 | B1 | 5/2002 | Matyko |
| 6,694,781 | B1 | 2/2004 | Li |
| 6,718,802 | B2 | 4/2004 | Vito |
| 7,299,668 | B1 | 11/2007 | Lu |
| 8,266,933 | B2 | 9/2012 | Bishir, Jr. et al. |
| 8,347,664 | B2 | 1/2013 | Bishir, Jr. et al. |
| 8,353,186 | B2 | 1/2013 | Schaefer |
| 8,640,507 | B1 | 2/2014 | Derman |
| 8,820,125 | B1 | 9/2014 | Dolev |
| 9,506,274 | B1 | 11/2016 | Miracle |
| 9,562,373 | B1 | 2/2017 | Young et al. |
| 10,577,833 | B1 * | 3/2020 | Telang ..... E05B 67/24 |
| 2006/0059962 | A1 | 3/2006 | Shabtay et al. |
| 2013/0086955 | A1 | 4/2013 | Derman |
| 2015/0361692 | A1 | 12/2015 | Kindstrand et al. |
| 2016/0053515 | A1 | 2/2016 | Kindstrand et al. |
| 2016/0168881 | A1 | 6/2016 | Smith et al. |

OTHER PUBLICATIONS

Written Opinion of the International Searching Authority; International Searching Authority; International Application No. PCT/US2019/046180; dated Nov. 19, 2019; 4 pages.
Extended European Search Report; European Patent Office; European Patent Application No. 19846907.4; dated Nov. 25, 2020; 11 pages.

* cited by examiner

COMPACT BIKE LOCK

CROSS REFERENCE TO RELATED APPLICATIONS

The present application is a continuation of U.S. patent application Ser. No. 16/100,702 filed Aug. 10, 2018 and issued as U.S. Pat. No. 10,577,833, the contents of which are incorporated herein by reference in their entirety.

TECHNICAL FIELD

The present disclosure generally relates to portable locks, and more particularly but not exclusively relates to shackles for such locks.

BACKGROUND

Portable locks for securing bicycles frequently include a crossbar and a U-shaped shackle that is removably coupled to the crossbar via a locking mechanism seated in the crossbar. These locks, often referred to as "U-locks" owing to the shape of the shackle, are typically able to provide favorable levels of security at a relatively low weight in comparison to certain other forms of portable locks, such as those involving chains or articulating shackles. However, these U-locks are not without their drawbacks. For example, the large size and rigid nature of the U-shaped shackle may render the lock difficult to carry when not in use, and may hinder the use of the lock in tight or cramped spaces.

Another area of concern for U-locks is susceptibility to saw attacks, as the elongated and exposed shackle provides the attacker with a relatively large space in which to work the saw. When the saw is used to cut the shackle at the bend, the elongated legs naturally provide a large lever arm with which the locking mechanism can be pried. The shackles may also facilitate twisting attacks, in which a pry bar placed between the crossbar and the shackle is twisted to expand the opening formed by the cut.

As is evident from the foregoing, existing U-locks suffer from a variety of drawbacks and limitations associated with the U-shaped shackles thereof. For these reasons among others, a need remains for further improvements in this technological field.

SUMMARY

An exemplary shackle is configured for use with a crossbar having a pair of openings and a locking mechanism including a pair of deadbolts. The shackle includes a substantially flat plate portion having a length in a longitudinal direction, a width in a transverse direction, and a thickness along a lateral axis defining a proximal direction and a distal direction. The length is greater than the width, which is greater than the thickness. The shackle further includes a pair of longitudinally-offset legs extending distally from the plate portion. Each leg has a diameter, and includes a bumper and a notch positioned distally of the bumper. An offset distance is defined between the distal surface of the plate portion and the distal faces of the bumpers. The width of the plate portion is greater than each of the diameter and the offset distance. Further embodiments, forms, features, and aspects of the present application shall become apparent from the description and figures provided herewith.

DETAILED DESCRIPTION OF ILLUSTRATIVE EMBODIMENTS

Figure 1:
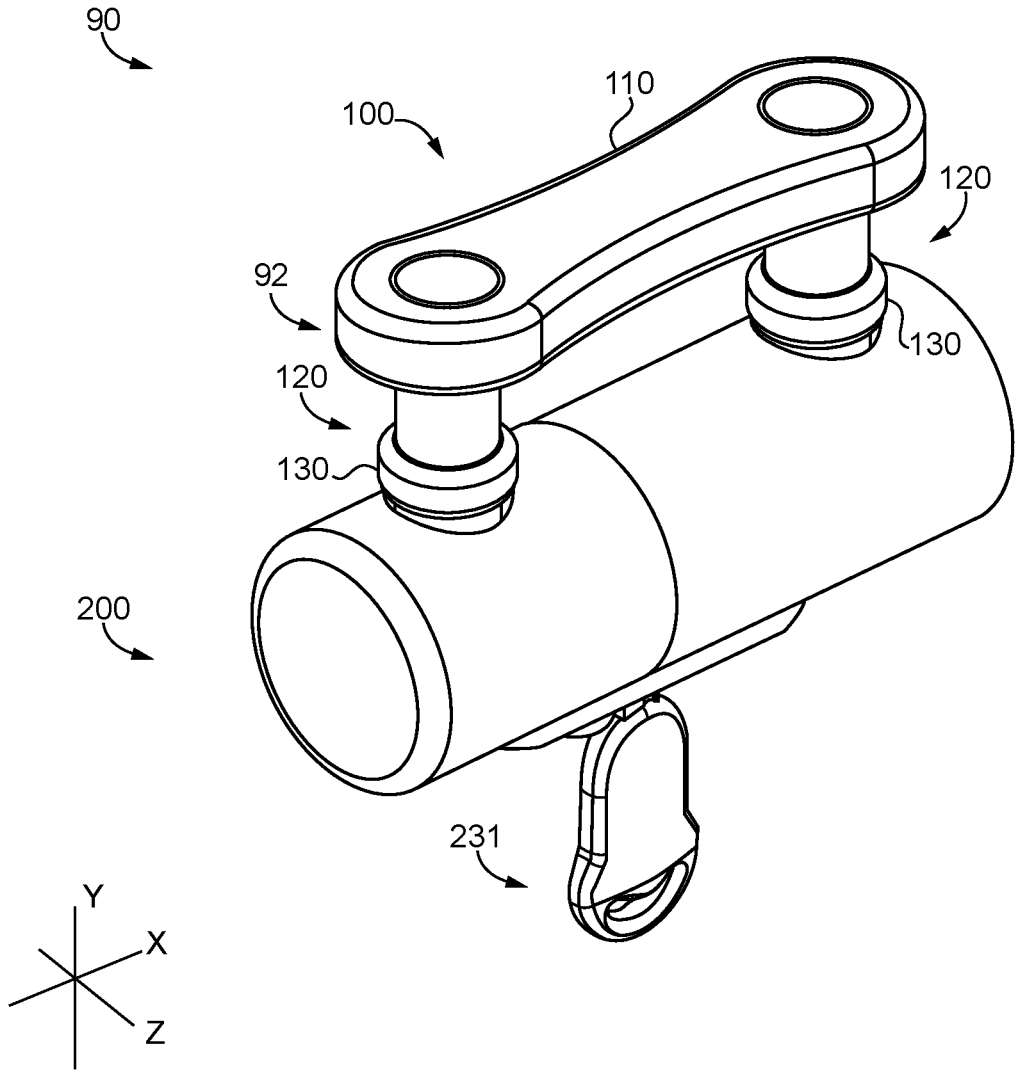
FIG. 1 is a perspective view of a lock including a shackle according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

As used herein, the terms "longitudinal," "lateral," and "transverse" are used to denote motion or spacing along three mutually perpendicular axes. In the coordinate system illustrated in FIG. 1, the X-axis defines the longitudinal directions, the Y-axis defines the lateral directions, and the Z-axis defines the transverse directions. Additionally, the descriptions that follow may refer to the directions defined by the axes with specific reference to the orientations illustrated in the Figures. For example, the lateral (Y) directions may be referred to as proximal and distal directions or upward and downward directions. These terms are used for ease and convenience of description, and are without regard to the orientation of the system with respect to the environment. Furthermore, motion or spacing along a direction defined by one of the axes need not preclude motion or spacing along a direction defined by another of the axes. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

Figure 2:
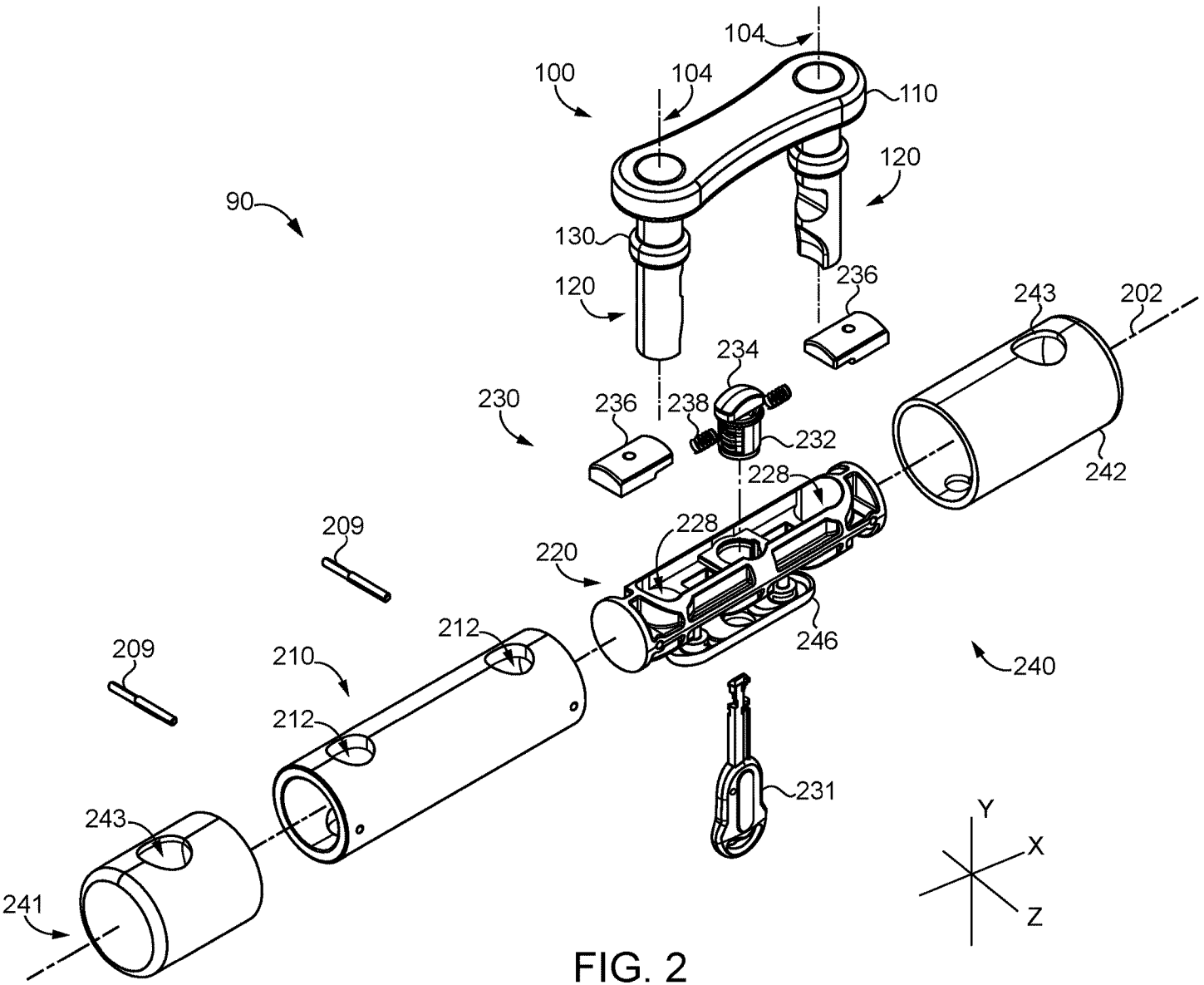
FIGS. 2 and 3 are exploded assembly views of the lock.
Figure 3:
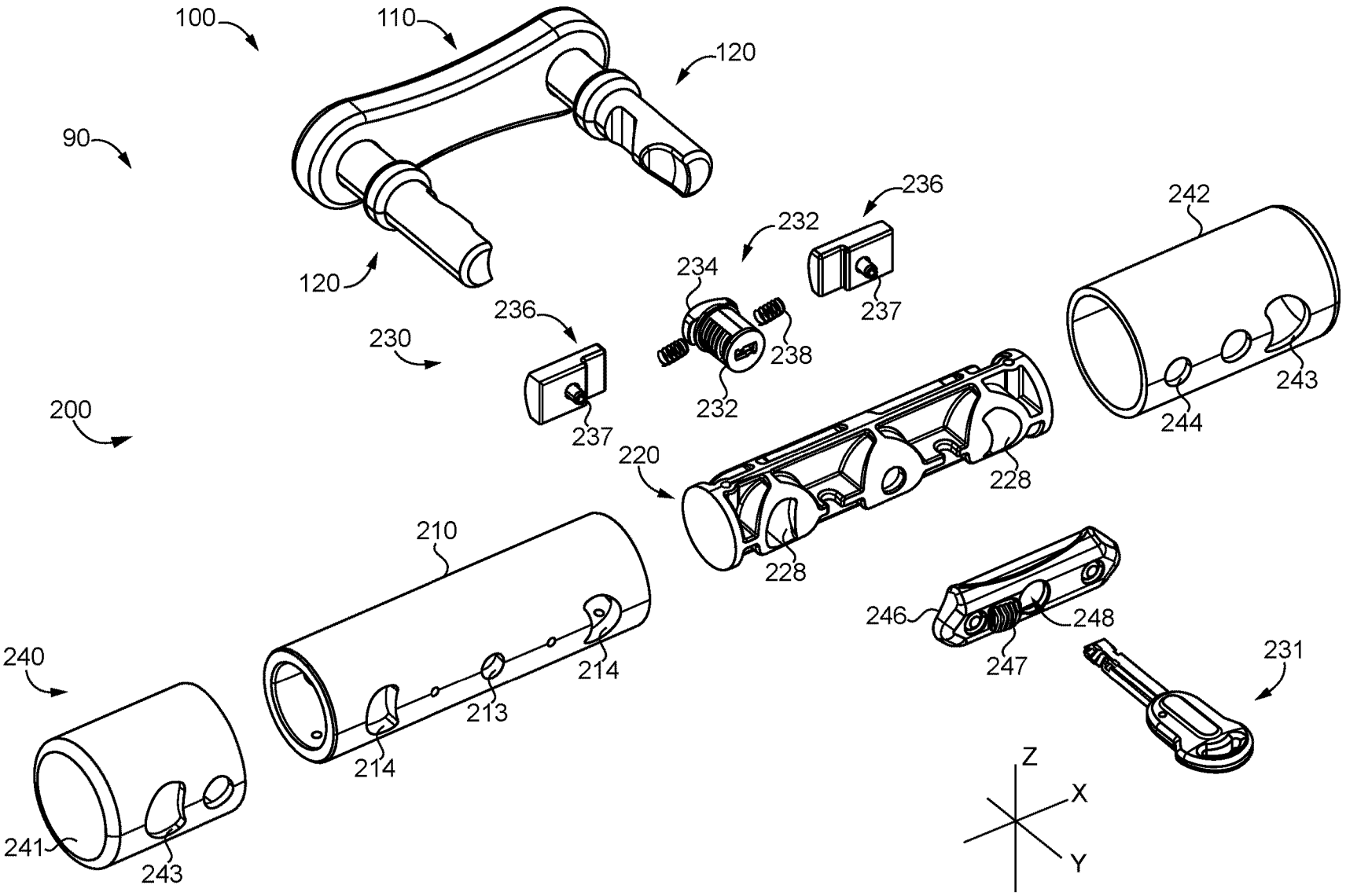
Figure 6:
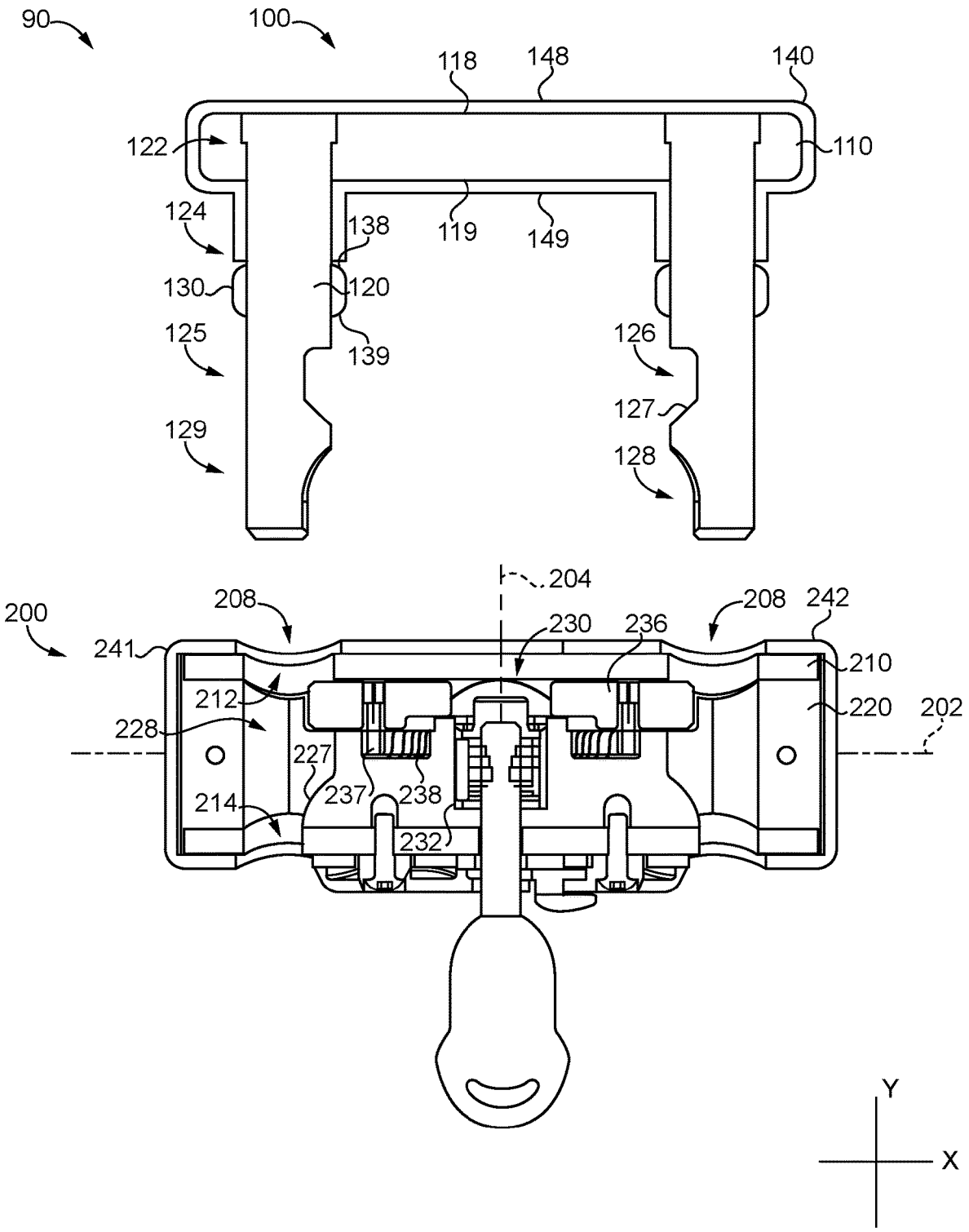
FIG. 6 is a cross-sectional illustration of the lock in a decoupled state.
Figure 7:
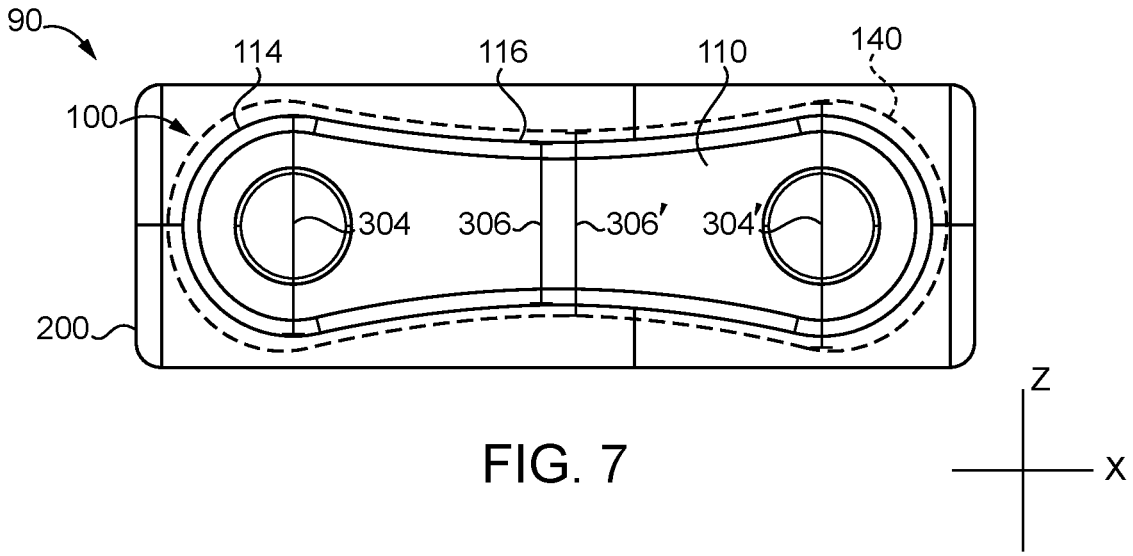
FIG. 7 is a top-down view of the lock in a coupled state.
Figure 8:
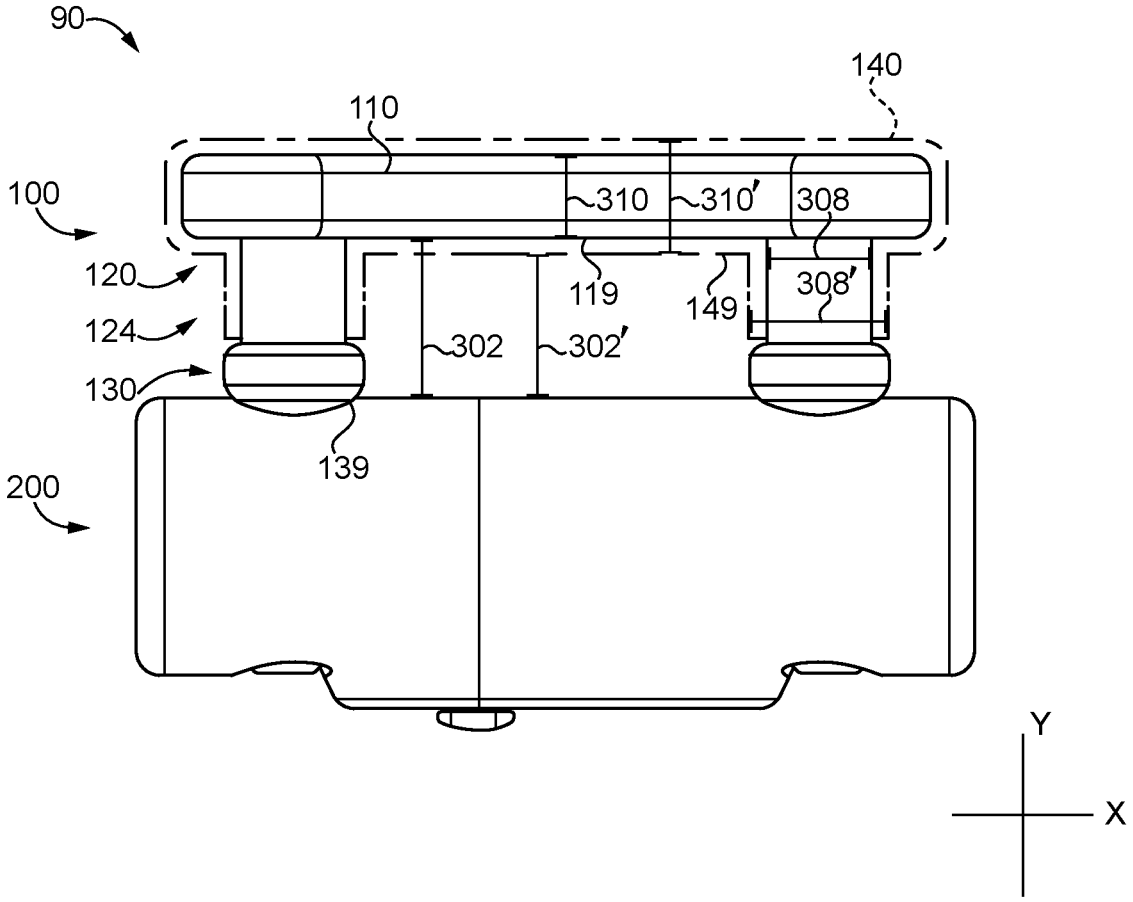
FIG. 8 is a front view of the lock in the coupled state.
Figure 10:
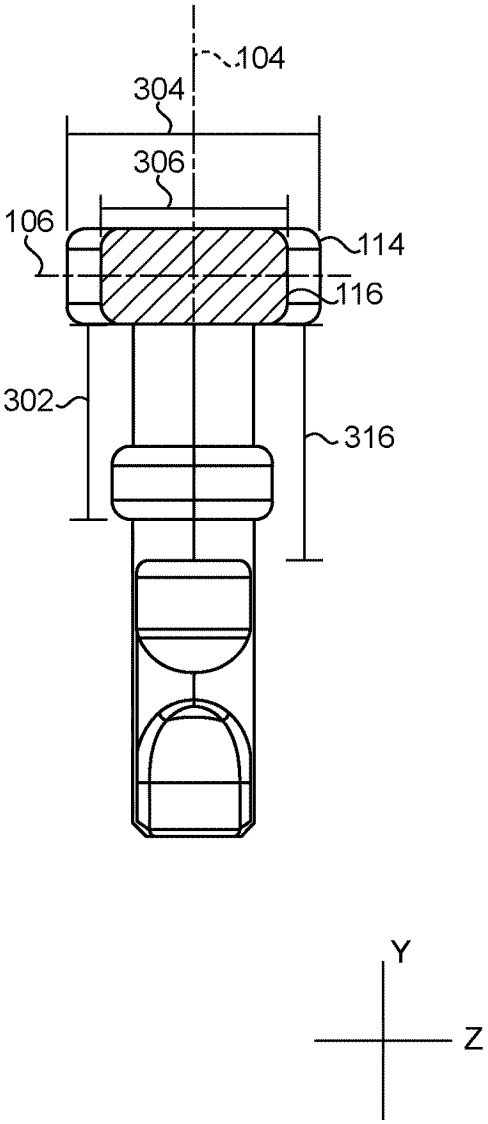
FIG. 10 is a cutaway side view of the shackle.

With reference to FIGS. 1-3, illustrated therein is a lock 90 according to certain embodiments. The lock 90 generally includes a shackle 100 and a crossbar 200 to which the shackle 100 is selectively coupled. The shackle 100 generally includes longitudinally-extending base plate portion 110 and a pair of longitudinally-spaced legs 120 extending from the plate portion 110 in a lateral direction, and may further include bumpers 130 and/or a cover 140 (FIGS. 6 and 7). The crossbar 200 extends along a crossbar longitudinal axis 202, and generally includes a tube 210, a housing 220 seated in the tube 210, a locking mechanism 230 in the tube 210 and engaged with the shackle 100, and a cover assembly 240 mounted to the outer side of the tube 210.

Figure 5:
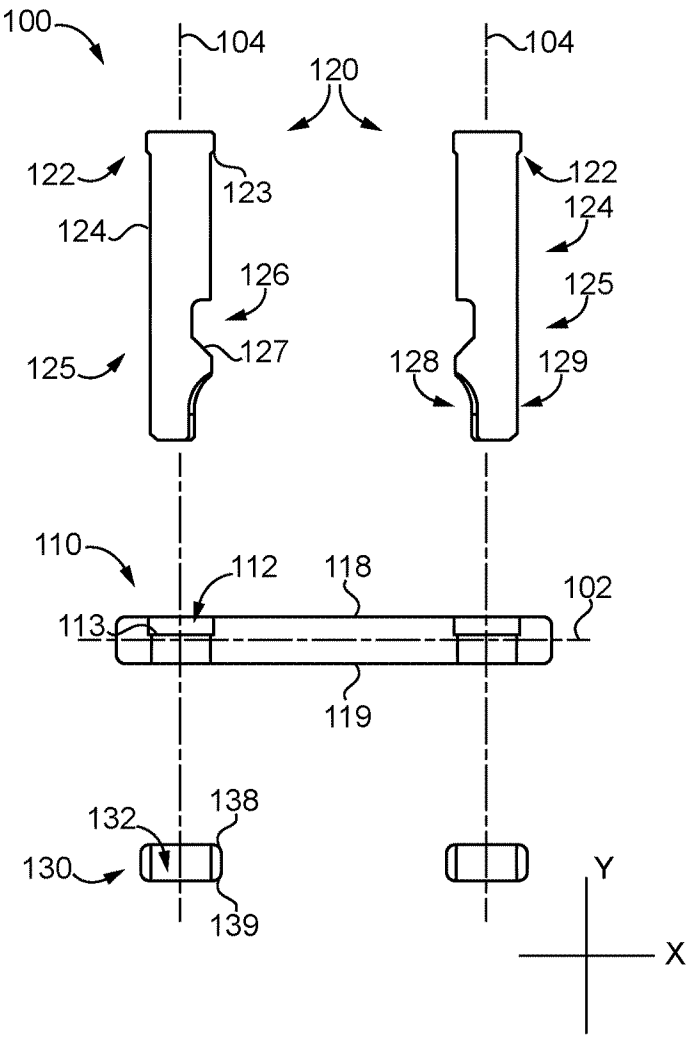
FIG. 5 is an exploded cross-sectional view of the shackle.
Figure 4:
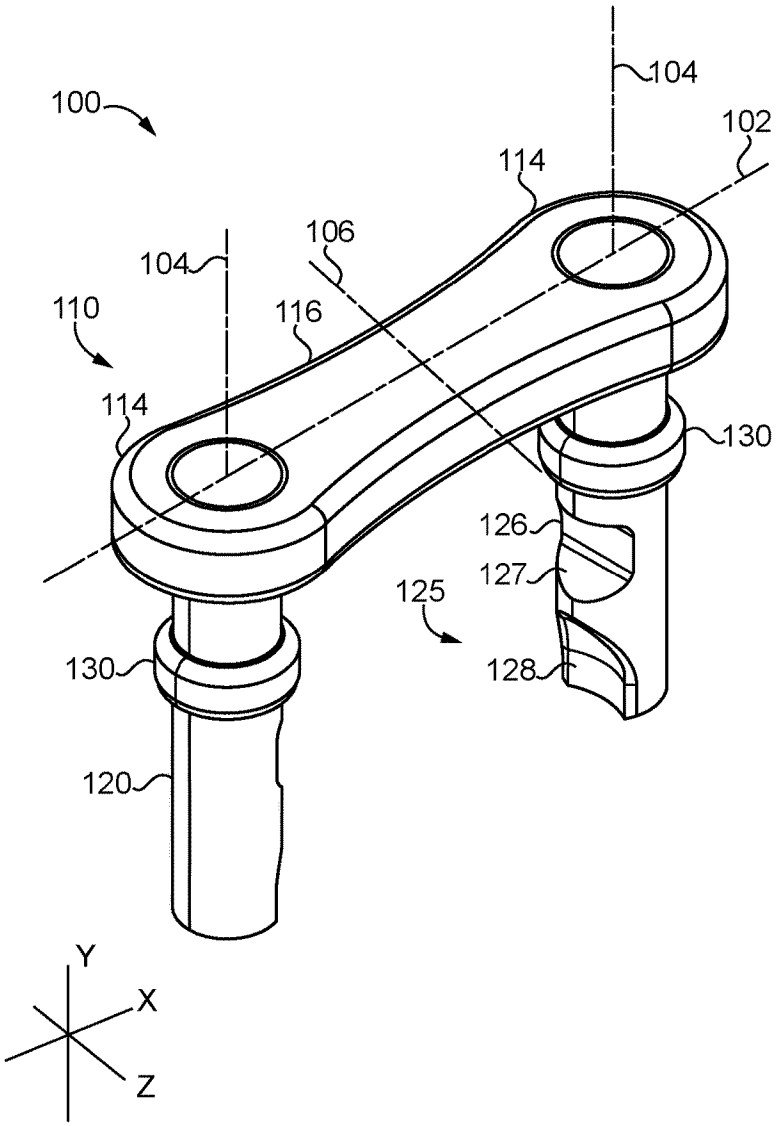
FIG. 4 is a perspective illustration of the shackle.

With additional reference to FIGS. 4-6, the plate portion 110 extends along a longitudinal (X) axis 102, and includes a pair of longitudinally-spaced openings 112, each of which extends through the plate portion 110 along a corresponding and respective lateral (Y) axis 104. Each of the openings 112 includes a step 113 such that the laterally-outward or upper portion of each opening 112 is larger than the laterally-inward or lower portion of each opening 112. The plate portion 110 includes a pair of enlarged end portions 114 through which the pair of openings 112 extend, and further includes a narrowed central portion 116 extending between and connecting the enlarged end portions 114. In the illustrated embodiment, the enlarged end portions 114 are wider than the narrowed central portion 116 in the transverse (Z) dimension. The plate portion 110 also has a proximal or upper surface 118 and a distal or lower surface 119, and the openings 112 extend laterally through the surfaces 118, 119 and the space therebetween.

Each leg 120 includes a base portion 122 including a shoulder 123, a second portion 124 extending distally from the base portion 122, and a foot portion 125 extending distally from the second portion 124. The base portion 122 is configured to be received in the opening 112, and includes a shoulder 123 such that the laterally-outward or upper portion of each base portion 122 is larger than the laterally-inward or lower portion of each base portion 122. The shoulder 123 is configured to abut the step 113 to seat the base portion 122 in the opening 112 while preventing the leg 120 from being passed entirely through the opening 112. The engagement features are configured to engage the crossbar 200 to aid in constraining the legs 120 relative to the crossbar 200 in various degrees of freedom.

Each foot 125 includes a notch 126 having a ramp 127 that is configured to engage the locking mechanism 230 in order to selectively prevent removal of the shackle 100 from the crossbar 200. Each foot 125 further includes a double-beveled recess 128, which is beveled about two axes. More particularly, the recess 128 is beveled about the lateral (Y) axis such that the tip 129 of the foot 125 takes the shape of a crescent moon. At least an upper portion of the recess 128 is further beveled about a transverse (Z) axis, which provides that portion with a geometry similar to that of an octant of a sphere or ellipsoid.

As noted above, the shackle 100 may further include one or more resilient bumpers 130, and in the illustrated form includes two bumpers 130 formed of an elastic material, such as rubber. Each bumper 130 is mounted to the second portion 124 of a corresponding leg 120 such that the leg 120 extends through a central opening 132 of the bumper 130. In certain embodiments, the bumpers 130 may be secured to the legs 120 using adhesives, while in other forms such adhesives may be unnecessary. The resilient material of the bumpers 130 may attenuate shocks resulting from the shackle 100 being rapidly inserted to the crossbar 200, and may aid in discouraging objects from entering the crossbar openings when the shackle 100 is coupled to the crossbar 200. Each bumper has an upper or proximal face 138 and an opposite lower or distal face 139, and the opening extends laterally through the faces 138, 139 and the space therebetween.

In certain embodiments, the shackle 100 may further include a protective cover 140 that covers the plate portion 110 and a portion of each leg 120. In the illustrated form, the cover 140 extends distally from the plate portion 110 to the upper faces 138 of the bumpers 130, thereby providing a backstop that prevents proximal movement of the bumpers 130 along the legs 120. In the illustrated form, the cover 140 is provided in the form of a sleeve 140 that provides for increased resistance to attack and tampering. The sleeve 140 may, for example, be formed of a hardened steel that is resistant to saw attacks. In certain embodiments, the cover 140 may comprise a coating formed of a low-durometer material, such as a material comprising at least one of a plastic, a rubber, or a polymer. The cover 140 includes an upper or proximal surface 148 adjacent the plate portion upper surface 118, and a lower or distal surface 149 adjacent the plate portion lower surface 119.

During assembly of the shackle 100, the legs 120 are oriented such that the engagement features face one another, and the tip portions 129 are passed through the openings 112 such that the base portions 122 enter the openings 112 and the shoulders 123 abut the steps 113. The base portions 122 and the openings 112 may be configured to aid in the bringing the legs 120 to the appropriate orientation relative to the plate portion 110. For example, the shoulder 123 may be formed by a spline, and the step 113 may be formed by a slot operable to receive the spline. The slot and the spline may be oriented such that when the base portions 122 are received in the openings 112 and the splines are received in the slots, the crossbar-engaging features of the two legs 120 face one another.

With the base portions 122 seated in the openings 112 and the legs 120 in the appropriate orientations relative to the plate portion 110, the legs 120 are secured to the plate portion 110. For example, the legs 120 may be welded to the plate portion 110. It is also contemplated that the legs 120 may be securely joined to the plate portion 110 in additional or alternative manners, such as those including adhesion, swaging, staking, fusing, or other techniques. Alternatively, the plate portion 110 and the legs 120 may be provided as an integrally formed and monolithic structure, such as by machining the joined components from a single contiguous block of material, or by casting or forging the joined components as a single structure. Regardless of the precise manner in which the legs 120 are joined to the plate portion 110, the legs 120 may be fixedly, immovably, and non-rotatably coupled with the plate portion 110. As a result, the plate portion 110 prevents relative movement of the legs 120 in all degrees of freedom.

With additional reference to FIG. 7, the crossbar 200 defines a pair of openings 208 sized and shaped to closely receive the feet 125 of the shackle 100. The openings 208 are defined in part by the tube 210, and more particularly by a set of apertures formed in the tube 210. A first pair of spaced-apart apertures 212 are formed in an upper side of the tube 210, and a second pair of spaced-apart apertures 214 are formed diametrically opposite the first pair of apertures 212. The openings 208 are further defined by the housing 220, which includes a corresponding set of openings 228 that are aligned with the tube apertures 212, 214. Each housing opening 228 is defined in part by a double-beveled wall 227 having a geometry corresponding to that of the beveled recess 128, and each of the second apertures 214 has a crescent-shaped geometry corresponding to that of the tips 129 of the shackle feet 125. The tube 210 and the housing 220 are secured to one another, for example using press-fit pins 209, thereby maintaining alignment of the elements defining which the openings 208.

The locking mechanism 230 extends along a central lateral axis 204, and is operable by a key 231. The locking mechanism 230 generally includes a lock cylinder 232, a cam 234 mounted to a spindle of the lock cylinder 230, a pair of deadbolts 236 slidably captured between the housing 220 and the inner surface of the tube 210. The lock cylinder 232 is mounted to the housing 220, and is aligned with an aperture 213 that is formed in the tube 210 and through which the key 231 can be inserted to the lock cylinder 230. The locking mechanism 230 further includes a pair of springs 238 longitudinally biasing the deadbolts 236 in a direction away from the central lateral axis 204. For example, a pin 237 may be mounted to each deadbolt 236, and the springs 238 may be captured between the pins 237 and walls of the housing 220 to bias the deadbolts 236 longitudinally outward.

As used herein, longitudinal directions leading away from the central lateral axis 204 may be referred to herein as longitudinally outward directions, and longitudinal directions leading toward the central lateral axis 204 may be referred to herein as longitudinally inward directions. Thus, while one spring 238 biases the right-hand deadbolt 236 in the illustrated rightward direction and the other spring 238 biases the left-hand deadbolt 236 in the illustrated leftward direction, each of the springs 238 biases the corresponding deadbolt 236 in its longitudinally-outward direction.

The cam 234 has a longer dimension and a shorter dimension, and is rotatable between a locking position and an unlocking position. In the locking position, the longer dimension is aligned with the deadbolts 236, and retains the deadbolts 236 in the extended positions thereof. In the unlocking position, the shorter dimension of the cam 234 is aligned with the deadbolts 236. As a result, the deadbolts 236 can be urged from their extended positions to their retracted positions, for example upon insertion of the feet 125 into the openings 208.

The cover assembly 240 provides a protective outer shell for the crossbar 200, and generally includes a first sleeve 241, a second sleeve 242, and a dust cover 246 including a slider 247. Each of the sleeves 241, 242 includes a set of apertures 243 that are generally aligned with the tube apertures 212, 214, and which partially define the crossbar openings 208. The second sleeve 242 further includes an additional aperture 244 that is aligned with the lock cylinder 232, and through which the key 231 can be inserted to the lock cylinder 232. The dust cover 246 includes a corresponding aperture 248, and the slider 247 is operable to slide over the aperture 248 to discourage the entry of debris into the lock cylinder 232. Like the above-described shackle cover 140, the illustrated cover assembly 240 is configured to provide for increased resistance to attack and tampering. The sleeves 241, 242 may, for example, be formed of a hardened steel that is resistant to saw attacks.

With the crossbar 200 assembled, the shackle 100 may be attached to the crossbar 200 to define an enclosed hoop 92 that may be used to secure a movable object to a stationary object. To do so, a portion of each object is placed within the area that will be enclosed by the hoop 92. The key 231 is inserted into the lock cylinder 232 and rotated to place the cam 234 in its unlocking position, and the feet 125 are inserted into the crossbar openings 208. As the feet 125 enter the openings 208, the beveled recesses 128 urge the deadbolts 236 longitudinally inward against the biasing force of the springs 238. As the notches 126 move into alignment with the deadbolts 236, the tips 129 enter the second apertures 214, and the bumpers 130 approach the outer surface of the crossbar 200. When the notches 126 become aligned with the deadbolts 236, the springs 238 urge the deadbolts 236 into engagement with the notches 126. In this state, the shackle 100 is latched to the crossbar 200, and the lock 90 is in a latched state.

With the lock 90 in the latched state, the key 231 may be rotated to return the cam 234 to its locking position, thereby moving the lock 90 to a locked state. In the locked state, the long dimension of the cam 234 is aligned with the deadbolts 236 such that the cam 234 retains the deadbolts 236 in the extended or longitudinally outward positions thereof. Should the user attempt to remove the shackle 100 in this state, the deadbolts 236 engage the ramps 127 of the notches 126, thereby preventing removal of the feet 125 from the openings 208.

From the locked state, the lock 90 can be returned to the latched state by inserting and rotating the key 231, thereby moving the cam 234 to its unlocking position. In this state, the shackle 100 and crossbar 200 can be separated by pulling the components apart from one another. Such relative movement of the shackle 100 and crossbar 200 causes the ramps 127 to urge the deadbolts 236 to the longitudinally inward against the force of the springs 238, thereby driving the deadbolts 236 to the retracted positions thereof.

With additional reference to FIGS. 7-10, certain features of the assembled lock 90 may aid in discouraging or defeating one or more types of attack or tampering. In addition to traditional attack-defeating measures, such as selecting appropriate materials and hardening various components of the lock 90, various dimensions 300 of the lock 90 may aid in providing resistance to certain forms of attack. While other forms are contemplated, in the illustrated embodiment, the maximum transverse width 304 of the plate portion 110 is greater than the offset dimension 302 defined between the plate portion 110 and the crossbar 200, and the offset dimension 302 is substantially constant. Additionally, the minimum transverse width 306 of the plate portion 110 is greater than the diameter 308 of the legs 120, and corresponds to the offset dimension 302. The significance of these and other relative dimensions will become apparent in light of the following.

One common attack on bike locks is a saw attack, in which a saw or other cutting instrument is used to cut a portion of the shackle in an attempt to open the hoop. Such saw attacks can be performed at either the bent portion of the shackle or at one of the legs. The lock 90 has various dimensions that may aid in rendering such forms of attack more difficult. One dimension is the exposed length 302 of the legs 120, which corresponds to the distance by which the bottom surface 119 of the plate portion 110 is offset from the top surface of the crossbar 200. This dimension 302 may equivalently be measured between the bottom surface 119 of the plate portion 110 and the bottom face 139 of the bumper 130, and may alternatively be referred to as the offset dimension 302. This exposed length 302 is much less than the corresponding dimension in conventional U-locks, which may make the attack more difficult. For example, the close proximity of the plate portion 110 and the crossbar 200 may hinder the use of powered saws, which typically require more clearance than provided between the plate portion 110 and the crossbar 200. In certain forms, the offset dimension 302 may be one inch or less.

With access to the legs 120 hindered by the relatively low exposed length 302, the attacker may attempt to saw through the plate portion 110. However, the transverse width dimensions of the plate portion 110 are selected to discourage such an attack. More particularly, the maximum transverse width 304 of the plate portion (i.e., the width at the thickest portion of the enlarged sections 114) is greater than the minimum transverse width 306 of the plate portion 110 (i.e., the width at the thinnest portion of the narrowed section 116), which is greater than the diameter 308 of the second portions 124 of the legs 120. As a result, each stroke of the blade may need to remove more material than would be required if attacking the leg 120, which may increase the amount of time required to form a cut of a given depth. Additionally, the lateral thickness 310 of the plate portion 110 may be selected such that the minimum cross-sectional area of the narrowed section 116 is greater than the cross-sectional area of the exposed portions of the legs 120. As a result, more material must be removed to complete the cut, which further hinders the attack.

Should the attacker succeed in cutting through the plate portion 110, the attacker must increase the size of the cut opening to a size sufficient to move at least one of the objects outside the hoop 92. The attacker may attempt to do so by pivoting the cut portions of the shackle 100 in opposite directions about the lateral axes 104. With each of the cut segments of the plate portion 110 securely fixed to the base portion 122 of the corresponding leg 120, these torques are transmitted to the crossbar 200 via the feet 125. These torques are partially counteracted by the locking assembly 230, which retains the deadbolts 236 in the extended positions thereof. Further torque resistance is provided by each of the tube 210 and the housing 220. More particularly, the crescent-shaped tips 129 of the feet 125 engage the correspondingly-shaped walls defining the second apertures 214 and the housing openings 228, such that both the tube 210 and the housing 220 resist rotation of the legs 120 about the lateral axes 104.

The attacker may additionally or alternatively attempt to separate the cut sections of the plate portion 110 from one another by twisting the legs 120 in opposite directions about the longitudinal axis 202 of the crossbar 200. As will be appreciated, the length of the lever arms defined by the legs 120 correspond to the amount of torque that will be generated by a given force, as well as the linear separation that will result from a given degree of twisting. Thus, the short exposed dimension 302 of the legs 120 aids in reducing both the amount of torque that can be applied and the degree of separation resulting from such torque. Furthermore, the short length of the offset dimension 302 hinders the insertion of a pry bar between the plate portion 110 and the crossbar, as may be attempted by a person intending to provide additional leverage for the twist attack.

Certain additional relative dimensions of the shackle may provide further attack resistance along lines similar to those set forth above. For example, one area of engagement that may provide a pivot point during twist attacks is the interface between the tips 129 and the crescent-shaped apertures 214 of the tube. The lever arm available for such an attack is limited to a length corresponding to the lateral length dimension 312 of the legs 120, which is less than the longitudinal length dimension 311 of the plate portion 110. Another area of engagement that may provide a pivot point during twist attacks is the interface between the deadbolts 236 and the upper surface of the notches 126. The lever arm available for such an attack is limited to a length corresponding to the distance 316 between the plate portion 110 and the notch 126, which corresponds to the maximum transverse width 304 of the plate portion 110.

In embodiments where the shackle 100 includes the cover 140, the dimensions of the cover 140 may be included in or omitted when determining the dimensions described herein. Additionally, the inclusion or omission of the dimensions of the cover 140 may depend upon whether or not the dimension in question provides appreciable resistance to saw and/or twist attacks. When calculating the plate portion thickness 310, for example, portions of the cover 140 that are formed of a low-durometer material (e.g., a rubber or plastic coating) may be omitted from consideration, while those portions formed of a high-durometer metal (e.g., hardened steel) may be considered to constitute a portion of the dimension in question. Dimensions that account for the thickness of the cover are designated with similar reference characters as those that do not, and may be compared along similar lines. For example, it is noted above that the minimum transverse width 306 of the plate portion 110 is greater than the diameter 308 of the second portions 124 of the legs 120. Similarly, when the thickness of the cover 140 is taken into account, the minimum transverse width 306' of the plate portion 110 is greater than the diameter 308' of the second portions 124 of the legs 120.

Figure 9:
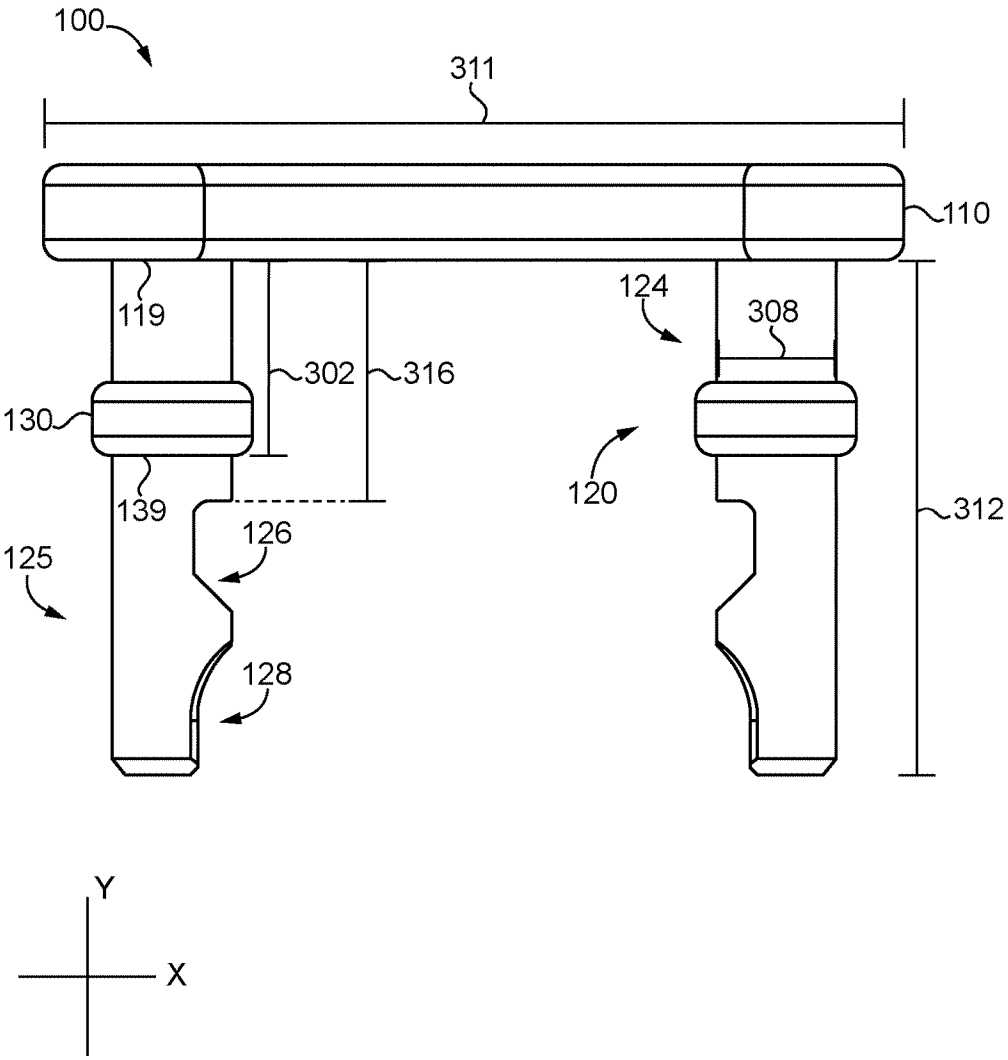
FIG. 9 is a front view of the shackle.

Herein, a cross-section may be described with reference to the direction that is orthogonal to the plane along which the cross-section is taken. For example, a cross-section taken along a plane including the longitudinal axes 102, 202 and the lateral axes 104 may be described as a transverse cross-section, as the transverse direction is orthogonal to the longitudinal and lateral directions. Under such a convention, the cross-sections illustrated in FIGS. 4 and 6 are referred to as transverse cross-sections, and the cross-section illustrated in FIG. 9 is referred to as a longitudinal cross-section.

In the illustrated form, the longitudinal cross-section of the plate portion (FIG. 10) is substantially rectangular. It is also contemplated that the plate portion 110 may have another cross-sectional geometry. For example, the plate portion 110 may have a pentagonal cross-sectional geometry in which the upper surface 118 includes a vertex of the pentagon, which may make saw attacks more difficult to execute.

Figure 12:
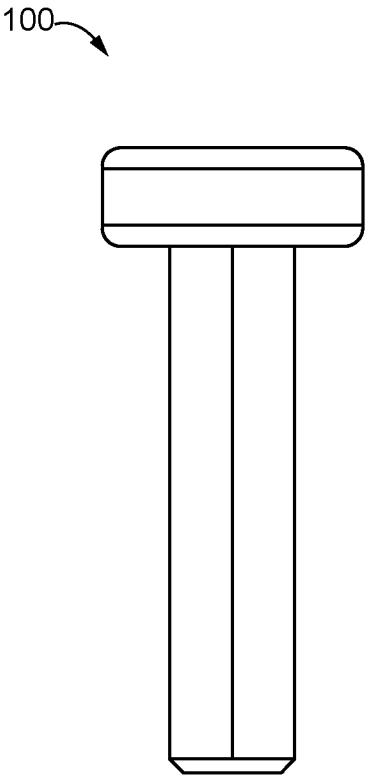
FIG. 12 is a right-side view of the shackle.
Figure 11:
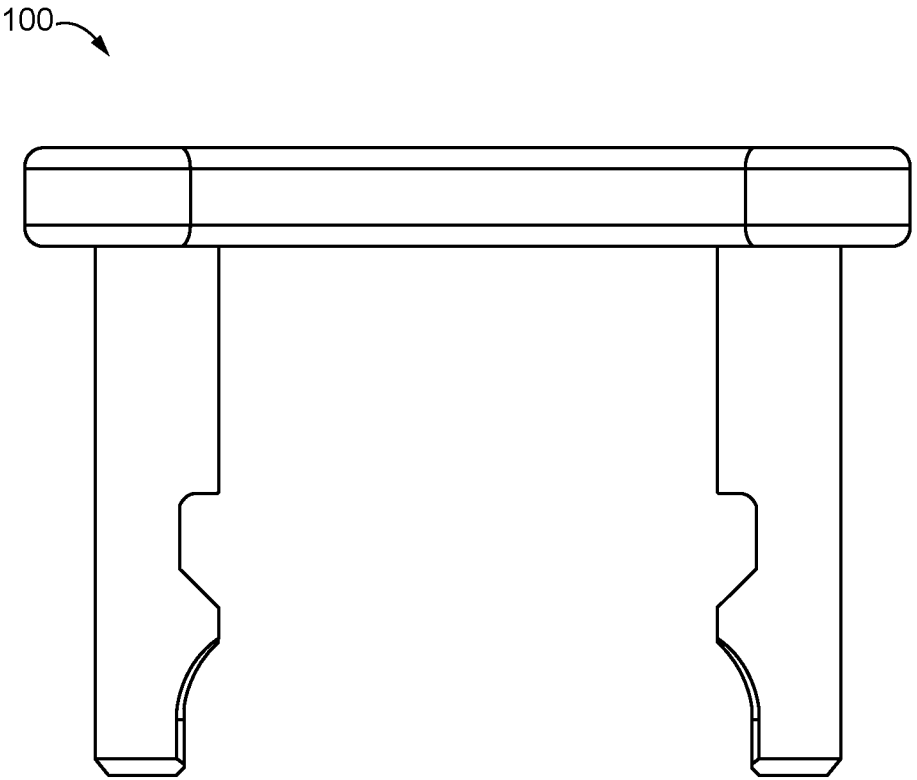
FIG. 11 is a front view of the shackle.
Figure 15:
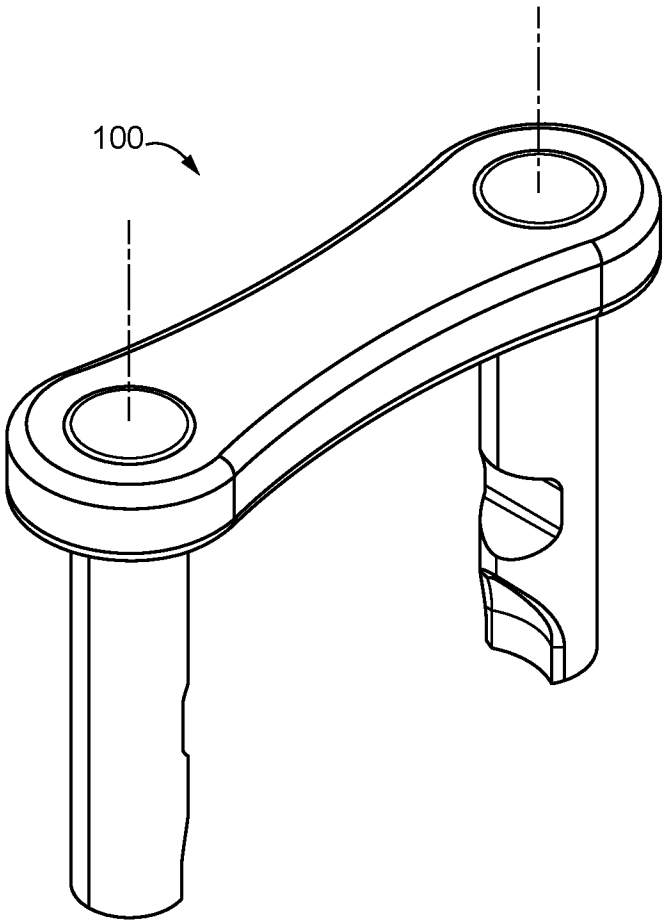
FIG. 15 is a perspective view of the shackle.
Figure 13:
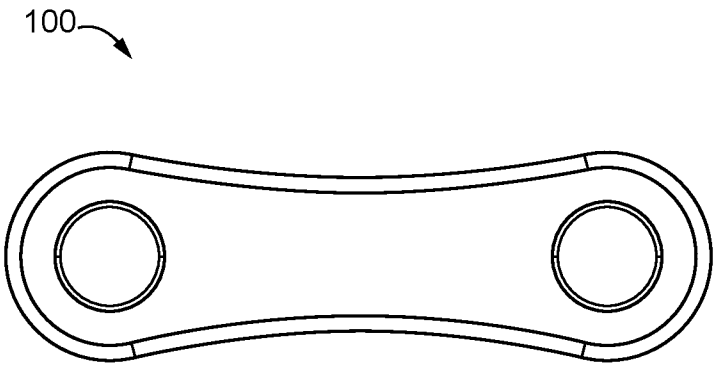
FIG. 13 is a top-down view of the shackle.
Figure 14:
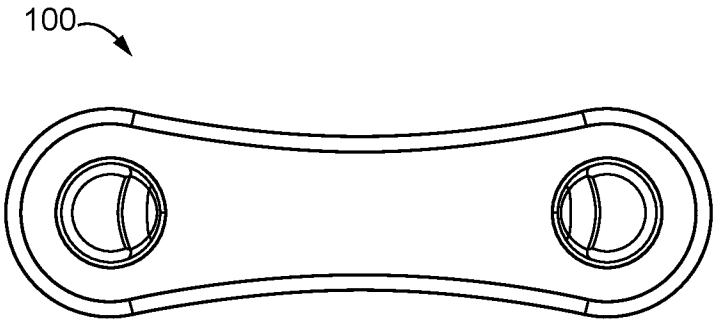
FIG. 14 is a bottom-up view of the shackle.

FIG. 11 is a front view of the shackle 100, which exhibits mirror-image symmetry relative to a central longitudinal-lateral (X-Y) plane. Accordingly, FIG. 11 is also a rear view of the shackle 100. FIG. 12 is a right-side view of the shackle 100, which exhibits mirror-image symmetry relative to a central lateral-transverse (Y-X) plane. Accordingly, FIG. 12 is also a left-side view of the shackle 100. FIG. 13 is a top-down view of the shackle 100, FIG. 14 is a bottom-up view of the shackle 100, and FIG. 15 is an isometric view of the shackle 100. In the interests of clarity, the bumpers 130 and cover 140 are omitted from FIGS. 11-15.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock, comprising:

a shackle, including:

a base plate portion having a length extending along a longitudinal axis and a maximum width extending along a transverse axis; and a pair of legs extending laterally from the base plate portion along a lateral axis and offset from one another along the longitudinal axis, wherein each of the legs includes a corresponding and respective distal portion; and a crossbar, including:

a pair of openings sized and configured to receive the corresponding and respective distal portion of the pair of legs; and a lock mechanism configured to selectively retain each distal portion of the shackle within a corresponding and respective one of the pair of openings to selectively secure the shackle to the crossbar; and wherein the base plate portion of the shackle is offset from the crossbar by an offset distance, and wherein the maximum width of the base plate portion is greater than the offset distance.

2. The lock of claim 1, wherein the base plate portion of the shackle has a thickness along the lateral axis, and wherein the maximum width of the base plate portion is greater than the thickness of the base plate portion.

3. The lock of claim 2, wherein the length of the base plate portion is greater than the maximum width of the base plate portion.

4. The lock of claim 1, wherein each leg of the pair of legs of the shackle are fixedly and immovably secured to the base plate portion, and wherein the base plate portion prevents relative movement of the legs.

5. The lock of claim 1, wherein each distal portion of the pair of legs of the shackle includes a corresponding and respective notch;

wherein the lock mechanism includes a pair of deadbolts; and wherein each of the deadbolts has an extended position in which each of the deadbolts is engaged with the corresponding and respective notch of each distal portion of the pair of legs of the shackle.

6. The lock of claim 1, wherein the base plate portion includes an enlarged portion defining the maximum width and a narrowed portion defining a reduced dimension that is less than the maximum width.

7. The lock of claim 6, wherein the offset distance is no greater than the reduced dimension of the base plate portion.

8. The lock of claim 1, wherein a tip of each distal portion of the shackle has a crescent-shaped cross-section;

wherein the pair of openings of the crossbar are crescent-shaped; and wherein the tip of each distal portion of the shackle is received in a corresponding and respective one of the crescent-shaped pair of openings in the crossbar to rotationally interlock each leg with the crossbar.

9. The lock of claim 1, further comprising a cover; and wherein the cover covers the base plate portion of the shackle and at least a portion of each leg of the pair of legs, but does not cover the distal portion of the pair of legs.

10. A shackle configured for use with a crossbar including a pair of openings and a locking mechanism including a pair of deadbolts, the shackle comprising:

a metallic base plate portion having a length in a longitudinal direction, a maximum width in a transverse direction, and a thickness in a lateral direction, wherein the length is greater than the maximum width, and wherein the maximum width is greater than the thickness;

a metallic pair of legs extending from the base plate portion in the lateral direction to a distal end, each leg of the pair of legs defining a leg length extending from the base plate portion to the distal end, and each leg having an outer diameter defining a leg width and a notch extending into the leg width, wherein each leg is configured to be received in a corresponding one of the pair of openings in the crossbar, and wherein the notch is configured for engagement with a corresponding and respective one of the pair of deadbolts of the locking mechanism to secure the shackle to the crossbar; and wherein the maximum width of the base plate portion of the shackle is greater than the leg width and a corresponding distance between the base plate portion and the notch.

11. The shackle of claim 10, wherein the base plate portion includes a pair of end portions that are offset from one another in the longitudinal direction, wherein the base plate portion includes a connecting portion extending between the end portions in the longitudinal direction, and wherein the end portions and the connecting portion are permanently and immovably coupled to one another.

12. The shackle of claim 11, wherein the base plate portion of the shackle comprises a planar plate.

13. The shackle of claim 11, wherein each of the end portions of the base plate portion includes a corresponding and respective aperture extending through the thickness in the lateral direction between upper and lower surfaces.

14. The shackle of claim 13, wherein each leg of the pair of legs extends from the corresponding and respective aperture in the base plate portion.

15. The shackle of claim 10, wherein the shackle further comprises a bumper seated on and coupled to each leg of the pair of legs, and wherein the bumper has an upper face and an opposite lower face, and wherein the upper face of the bumper faces the base plate portion of the shackle.

16. The shackle of claim 10, wherein the pair of legs are permanently and immovably secured to the base plate portion of the shackle.

17. The shackle of claim 10, wherein the base plate portion of the shackle is offset from the crossbar by an offset distance, and wherein the maximum width of the base plate portion is greater than the offset distance.

18. The shackle of claim 10, further comprising a cover, and wherein the cover covers the base plate portion of the shackle and at least a portion of each leg of the pair of legs, but does not cover the distal portions ends of the pair of legs.

19. The shackle of claim 18, wherein the cover comprises one of:

a coating formed of a material including at least one of a plastic, a rubber, and a polymer; and a sleeve formed of hardened steel.

20. The shackle of claim 10, wherein the base plate portion of the shackle has a curvilinear outer perimeter.

* * * * *